US006419479B1

(12) United States Patent
Huang

(10) Patent No.: US 6,419,479 B1
(45) Date of Patent: Jul. 16, 2002

(54) LIGHTER HAVING A SIMPLIFIED SAFETY LOCK

(76) Inventor: Ying Fang Huang, No. 2, Lane 22, Sec. 2, San Hsi Road, Taichung, 404 (TW)

( * ) Notice: Subject to any disclaimer, the term of this patent is extended or adjusted under 35 U.S.C. 154(b) by 0 days.

(21) Appl. No.: 09/761,478

(22) Filed: Jan. 18, 2001

(51) Int. Cl.[7] ..... F23D 11/36
(52) U.S. Cl. ..... 431/153; 431/255; 431/344
(58) Field of Search ..... 431/255, 153, 431/344, 345, 143, 266; 126/406, 411, 413; 42/70.07, 70.06

(56) References Cited

U.S. PATENT DOCUMENTS 5,145,358 A * 9/1992 Shike et al. ..... 431/153
5,934,895 A * 8/1999 McDonough et al. ..... 431/255
6,050,810 A 4/2000 Huang ..... 431/153
6,135,763 A * 10/2000 Man ..... 431/255
6,146,129 A * 11/2000 Li ..... 431/255
6,171,099 B1 * 1/2001 Lin ..... 431/255

* cited by examiner

*Primary Examiner*—James C. Yeung
(74) *Attorney, Agent, or Firm*—Rosenberg, Klein & Lee

(57) ABSTRACT

A lighter includes an igniting device received in a housing, a casing engaged with the igniting device, and a button engaged on the casing and having a catch for engaging into a lock opening of the housing. The button is guided to move up and down relative to the casing and moves toward and away from the igniting device together with the casing. A spring may bias the catch to engage into the lock opening of the housing and to lock the button to the housing. The igniting device may be actuated by the button when the catch is disengaged from the lock opening of the housing.

11 Claims, 4 Drawing Sheets

LIGHTER HAVING A SIMPLIFIED SAFETY LOCK

BACKGROUND OF THE INVENTION

1. Field of the Invention

The present invention relates to a lighter, and more particularly to a lighter having a safety lock for locking the trigger and for preventing the trigger from being depressed or actuated inadvertently.

2. Description of the Prior Art

The applicant's U.S. Pat. No. 6,050,810 to Huang discloses a typical lighter having a safety mechanism for locking the trigger and for preventing the trigger from being depressed or actuated inadvertently. However, the safety mechanism includes a complicated configuration that is adverse for manufacturing and assembling and marketing purposes.

The present invention has arisen to mitigate and/or obviate the afore-described disadvantages of the conventional lighters.

SUMMARY OF THE INVENTION

The primary objective of the present invention is to provide a lighter including a safety lock for locking the trigger and for preventing the trigger from being depressed or actuated inadvertently.

In accordance with one aspect of the invention, there is provided a lighter comprising a housing including an igniting device, and including a lock opening formed therein, a casing engaged with the igniting device and moved in concert with the igniting device, a button engaged on the casing and including a catch for engaging into the lock opening of the housing and to lock the button to the housing and to prevent the button from being actuated and moved relative to the housing, means for guiding the button to move up and down relative to the casing and to move toward and away from the igniting device in concert with the casing, and means for biasing the catch to engage into the lock opening of the housing and to lock the button to the housing. The button and thus the casing may be locked to the housing and may be prevented from being depressed against the igniting device when the catch of the button is engaged into the lock opening of the housing. The button and thus the casing may be depressed against the igniting device to actuate the igniting device only when the catch of the button is disengaged from the lock opening of the housing.

The guiding means includes a guide slot formed in the casing, and an arm extended from the button and slidably engaged in the guide slot of the casing to guide the button to move up and down relative to the casing.

The guiding means includes a rod extended in the casing, and a ring provided on the arm and slidably engaged on the rod for guiding the button to move up and down relative to the casing.

The rod includes a bottom portion having an orifice formed therein, the casing includes a cover having a pin engaged into the orifice of the rod. The biasing means includes a spring engaged on the rod and engaged between the casing and the cover.

The button includes at least one guide panel extended therefrom and slidably engaged with the casing to guide the button to move up and down relative to the casing. The button includes at least one guiding side wall extended therefrom and slidably engaged with the casing to guide the button to move up and down relative to the casing.

The casing includes an inner bottom peripheral portion having a peripheral shoulder formed therein, and a cover having a peripheral portion engaged in the peripheral shoulder of the casing.

The housing includes a guide channel formed therein, the casing includes a guide rib extended therefrom and slidably engaged in the guide channel of the housing. The casing includes a stop provided on the guide rib and slidably engaged with the housing for preventing the casing from being disengaged from the housing.

The button includes a front portion having a curved depression formed therein and includes a bottom portion having a projection extended therefrom for defining the curved depression thereof and for facilitating a depressing of the button against the biasing means.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
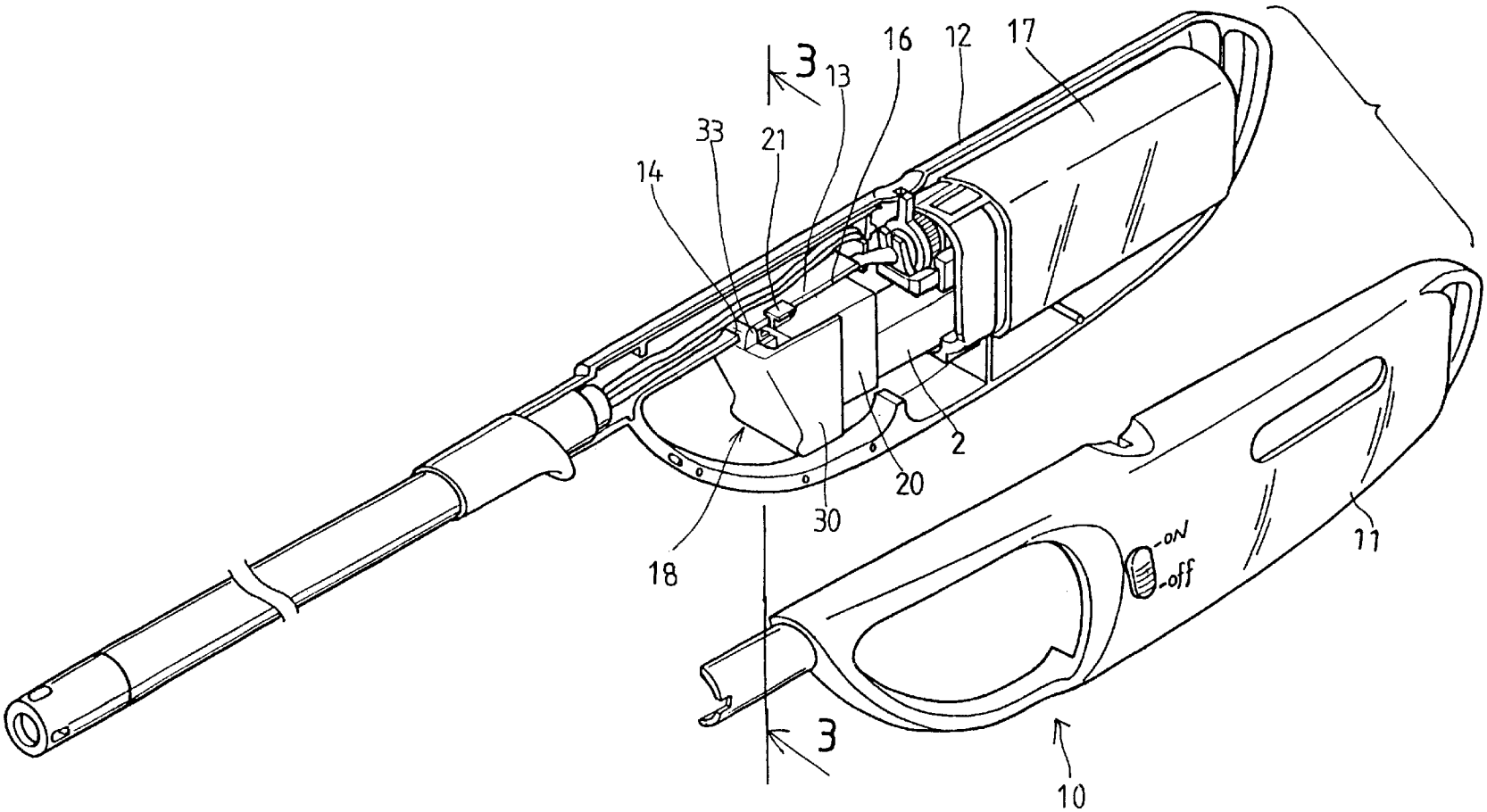
FIG. 1 is an exploded view of a lighter in accordance with the present invention.
Figure 2:
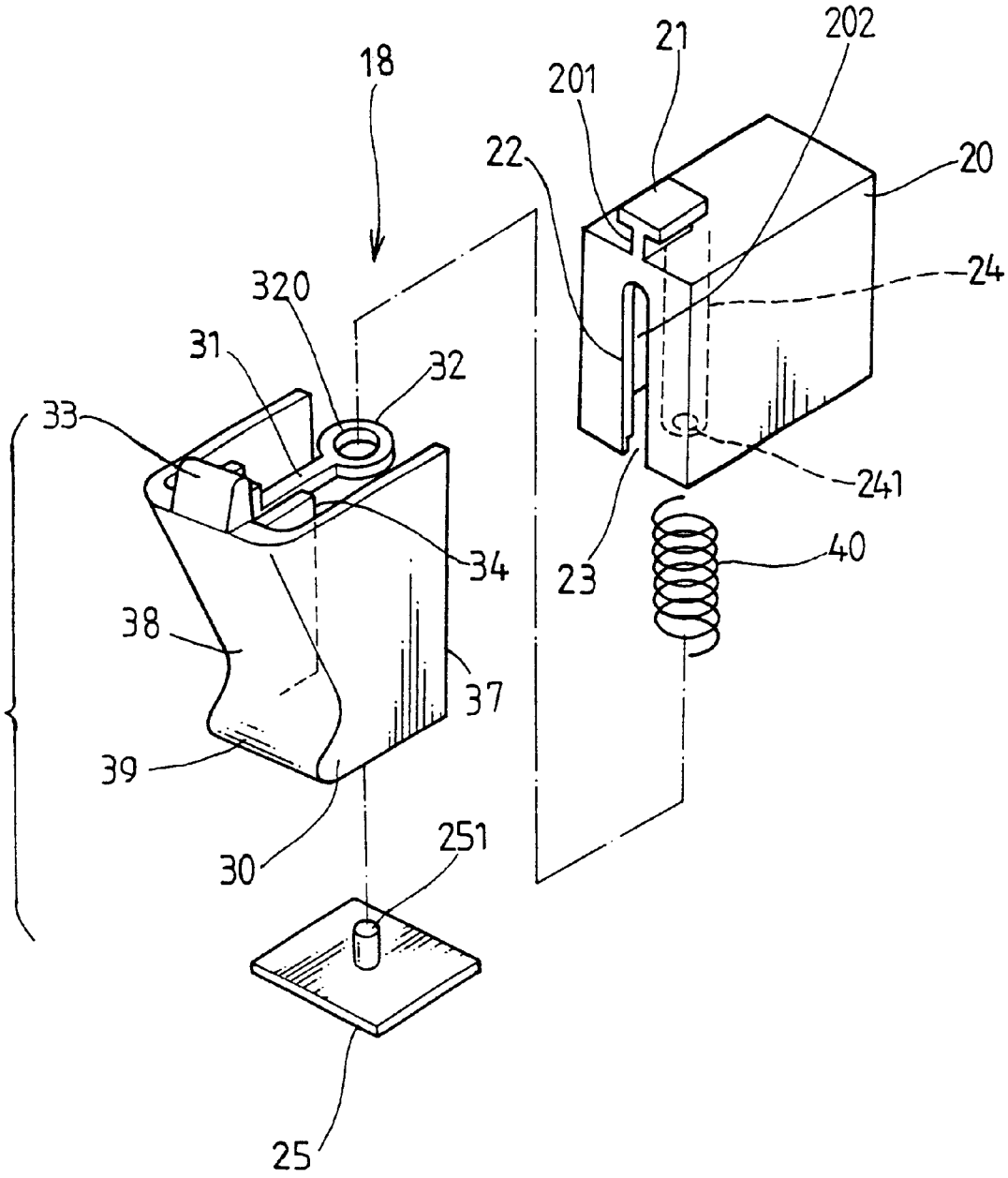
FIG. 2 is an exploded view of the trigger.
Figure 3:
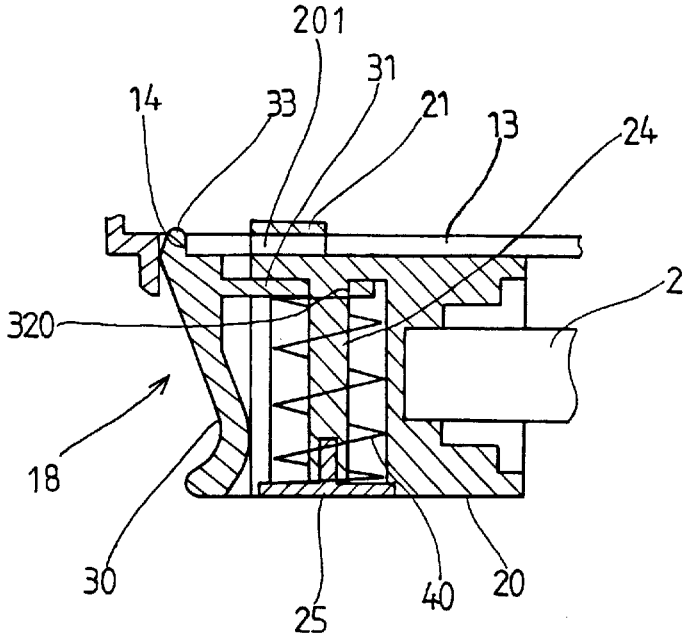
FIG. 3 is a partial cross sectional view taken along lines 3—3 of FIG. 1.

Referring to the drawings, and initially to FIGS. 1–3, a lighter in accordance with the present invention comprises a housing 10 including two housing members 11, 12 secured together by such as the fasteners, or by the welding processes or the like. A container 17 is received in the housing 10 for receiving the liquid gas or the other fuel materials. Alternatively, without the container 17, the gas may be directly received in the housing 10. The housing 10 includes a guide channel 16 longitudinally formed therein, and a lock opening 14 formed therein. For example, the housing members 11, 12 of the housing 10 each includes a flange 13 extended therein for forming or defining the guide channel 16 between the flanges 13. An igniting device 2 is received in the housing 10 and coupled to the container 17 for igniting purposes. A trigger device 18 is provided for actuating the igniting device 2 to ignite the gas flowing out of the container 17.

As best shown in FIGS. 2 and 3, the trigger device 18 includes a casing 20 having a guide rib 201 extended upward therefrom and slidably received in the guide channel 16 of the housing 10 for guiding the casing 20 to move forward and away from the igniting device 2 and/or the container 17. A stop 21 is provided on top of the rib 201 for engaging with the flanges 13 and for preventing the casing 20 from being disengaged from the housing 10. The casing 20 includes a chamber 202 formed therein, and includes a guide slot 22 formed in the front portion thereof, and includes a rod 24 extended inward of the chamber 202 of the casing 20 and parallel to the guide slot 22 of the casing 20, and includes a peripheral shoulder 23 formed in the inner and bottom peripheral portion thereof. The rod 24 includes an orifice 241 formed in the bottom portion thereof.

A button 30 includes an arm 31 extended rearward from the upper portion thereof and slidably received in the guide slot 22 of the casing 20 for guiding the arm 31 and thus the button 30 to move up and down relative to the casing 20. A retainer 32, such as a ring 32 is provided on the free end of the arm 31 and includes an aperture 320 formed therein for slidably receiving the rod 24 and for further guiding the arm 31 and thus the button 30 to move up and down relative to the casing 20. The button 30 includes a catch 33 extended upward therefrom for engaging into the lock opening 14 of the housing 10 and for preventing the button 30 and thus the casing 20 of the trigger device 18 from being depressed toward the igniting device 2 of the lighter.

A spring 40 is engaged on the rod 24 and engaged with the arm 31 or the ring 32 for biasing the arm 31 and thus the button 30 upward and for biasing the catch 33 to engage into the lock opening 14 of the housing 10 (FIG. 3) and to lock the trigger device 18 to the housing 10 and to prevent the trigger device 18 from being depressed inadvertently toward the igniting device 2 of the lighter, such that the trigger device 18 of the lighter may be prevented from being actuated inadvertently. A cover 25 has a peripheral portion engaged with the peripheral shoulder 23 of the casing 20 and includes a pin 251 extended therefrom and engaged into the orifice 241 of the rod 24. The cover 25 and/or the pin 251 may be secured to the casing 20 25 with an adhesive material, and/or with a force-fitted engagement, and/or by a welding process, etc. The cover 25 may engage with and may retain the spring 40 on the rod 24.

Figure 4:
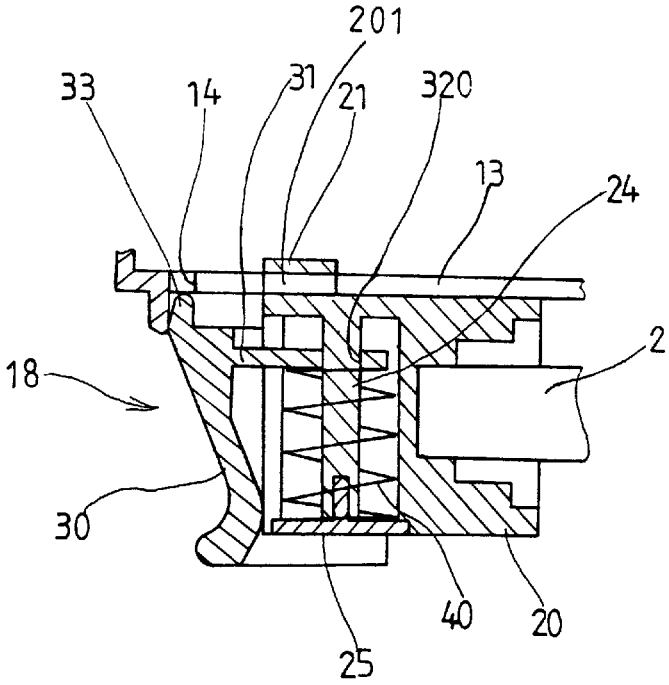
FIGS. 4 and 5 are partial cross sectional views similar to FIG. 3, illustrating the operation of the trigger for the lighter.
Figure 5:
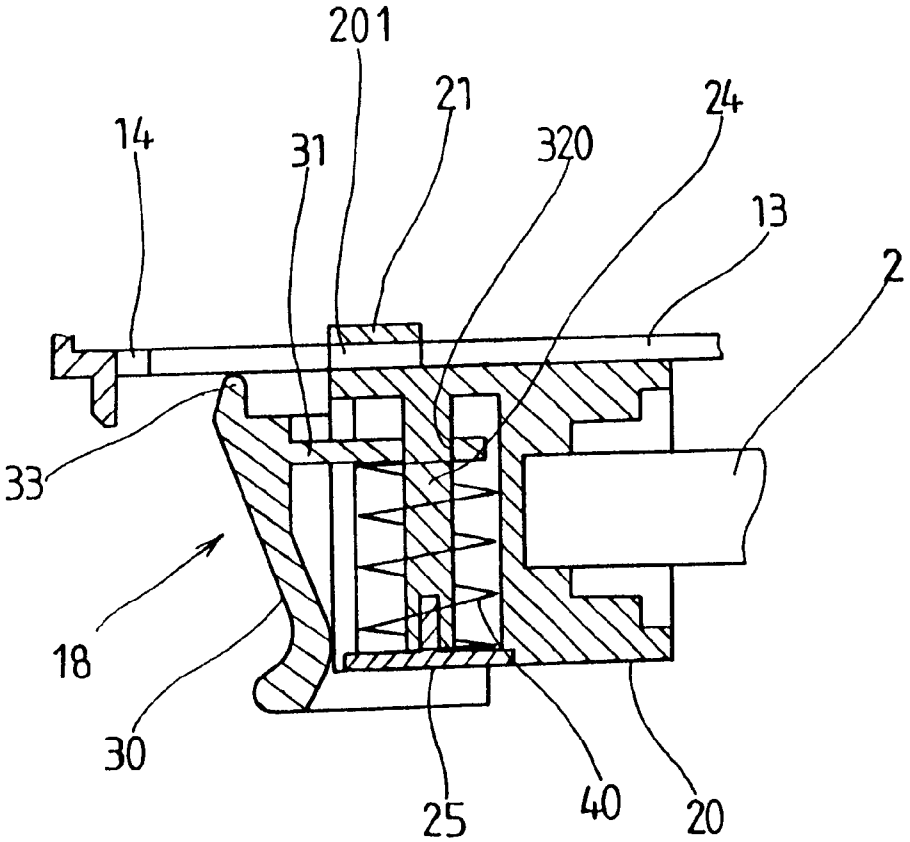

Referring next to FIGS. 4 and 5, the button 30 may be depressed downward against the spring 40 to disengage the catch 33 from the lock opening 14 of the housing 10 (FIG. 4), for allowing the button 30 and the casing 20 of the trigger device 18 to be depressed against the igniting device 2 and to trigger or actuate the lighter device 18. When the trigger device 18 is released, the igniting device 2 may bias or move the trigger device 18 away from the container 17, and the spring 40 may bias the catch 33 of the button 30 to engage into the lock opening 14 of the housing 10, in order to lock the trigger device 18 to the housing 10 again and so as to prevent the trigger device from being depressed or actuated inadvertently.

The casing 20 may also be secured to the igniting device 2 and moved in concert with the igniting device 2, without the sliding engagement of the rib 201 in the guide channel 16 of the housing 10. The button 30 includes one or more guide panels 34 extended therefrom and slidably engaged with the casing 20 for further stably guiding the button 30 to move up and down relative to the casing 20. It is preferable that the button 30 includes one or more guiding side walls 37 slidably engaged on the casing 20 for further stably guiding the button 30 to move up and down relative to the casing 20. The button 30 preferably includes a curved depression 38 (FIG. 2) formed in the front portion thereof and defined by a projection 39 in the bottom portion of the button 30. The user may engage with the projection 39 to facilitate the downward depressing of the button 30 against the spring 40.

Accordingly, the lighter in accordance with the present invention includes a safety lock for locking the trigger and for preventing the trigger from being depressed or actuated inadvertently.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A lighter comprising:

a housing including an igniting device, and including a lock opening formed therein, a casing engaged with said igniting device and moved in concert with said igniting device, a button engaged on said casing and including a catch for engaging into said lock opening of said housing and to lock said button to said housing and to prevent said button from being actuated and moved relative to said housing, means for guiding said button to move up and down relative to said casing and to move toward and away from said igniting device in concert with said casing, said guiding means including a guide slot formed in said casing, and an arm extended from said button and slidably engaged in said guide slot of said casing to guide said button to move up and down relative to said casing, and means for biasing said catch to engage into said lock opening of said housing and to lock said button to said housing.

2. The lighter according to claim 1, wherein said guiding means includes a rod extended in said casing, and a ring provided on said arm and slidably engaged on said rod for guiding said button to move up and down relative to said casing.

3. The lighter according to claim 2, wherein said rod includes a bottom portion having an orifice formed therein, said casing includes a cover having a pin engaged into said orifice of said rod.

4. The lighter according to claim 3, wherein said biasing means includes a spring engaged on said rod and engaged between said casing and said cover.

5. The lighter according to claim 1, wherein said button includes at least one guide panel extended therefrom and slidably engaged with said casing to guide said button to move up and down relative to said casing.

6. The lighter according to claim 1, wherein said button includes at least one guiding side wall extended therefrom and slidably engaged with said casing to guide said button to move up and down relative to said casing.

7. The lighter according to claim 1, wherein said button includes a front portion having a curved depression formed therein and includes a bottom portion having a projection extended therefrom for defining said curved depression thereof and for facilitating a depressing of said button against said biasing means.

8. A lighter comprising:

a housing including an igniting device, and including a lock opening formed therein, a casing engaged with said igniting device and moved in concert with said igniting device, said casing including an inner bottom peripheral portion having a peripheral shoulder formed therein, a cover having a peripheral portion engaged in said peripheral shoulder of said casing, a button engaged on said casing and including a catch for engaging into said lock opening of said housing and to lock said button to said housing and to prevent said button from being actuated and moved relative to said housing, means for guiding said button to move up and down relative to said casing and to move toward and away from said igniting device in concert with said casing, and means for biasing said catch to engage into said lock opening of said housing and to lock said button to said housing.

9. A lighter comprising:

a housing including an igniting device, and including a lock opening formed therein.

a casing engaged with said igniting device and moved in concert with said igniting device, said casing including a rod extended therein and having a bottom portion, a cover having a pin secured to said bottom portion of said rod, a button engaged on said casing and including a catch for engaging into said lock opening of said housing and to lock said button to said housing and to prevent said button from being actuated and moved relative to said housing, means for guiding said button to move up and down relative to said casing and to move toward and away from said igniting device in concert with said casing, and means for biasing said catch to engage into said lock opening of said housing and to lock said button to said housing.

10. A lighter comprising:

a housing including an igniting device, and including a lock opening formed therein, said housing including a guide channel formed therein, a casing engaged with said igniting device and moved in concert with said igniting device, said casing including a guide rib extended therefrom and slidably engaged in said guide channel of said housing, a button engaged on said casing and including a catch for engaging into said lock opening of said housing and to lock said button to said housing and to prevent said button from being actuated and moved relative to said housing, means for guiding said button to move up and down relative to said casing and to move toward and away from said igniting device in concert with said casing, and means for biasing said catch to engage into said lock opening of said housing and to lock said button to said housing.

11. The lighter according to claim 10, wherein said casing includes a stop provided on said guide rib and slidably engaged with said housing for preventing said casing from being disengaged from said housing.

* * * * *